United States Patent [19]

Yu

[11] Patent Number: 4,925,050

[45] Date of Patent: May 15, 1990

[54] BEVERAGE CAN

[76] Inventor: Zhou Yu, Department of Physics; Northwestern University, Evanston, Ill. 60201

[21] Appl. No.: 839,167

[22] Filed: Mar. 3, 1986

[51] Int. Cl.[5] ..... A47G 19/00

[52] U.S. Cl. ..... 220/90.2; 220/1 BC

[58] Field of Search ..... 220/90.2, 90.6, DIG. 13, 220/94 A, 1 BC, 449, 450, 458, 459, 465

[56] References Cited

U.S. PATENT DOCUMENTS

| | | | |
|---|---|---|---|
| 202,514 | 4/1878 | Brenner | 220/1 BC |
| 411,157 | 9/1889 | Leuchs et al. | 220/DIG. 13 X |
| 3,204,805 | 9/1965 | May | 220/90.2 X |
| 3,420,367 | 1/1969 | Carmichael | 220/1 BC X |
| 3,537,498 | 11/1970 | Amand | 220/94 A X |
| 3,704,805 | 12/1972 | Sheafe, III | 220/90.6 X |
| 3,799,423 | 3/1974 | Cvacho | 220/450 |
| 3,874,554 | 4/1975 | Chang | 220/90.2 |
| 3,890,448 | 6/1975 | Ito | 220/458 X |
| 4,020,969 | 5/1977 | Ando | 220/90.2 X |
| 4,503,992 | 3/1985 | Sitko et al. | 220/90.2 X |
| 4,574,970 | 3/1986 | Schwarz | 220/90.2 X |

*Primary Examiner*—Steven M. Pollard

*Attorney, Agent, or Firm*—Roger J. French

[57] ABSTRACT

The invention relates to beverage can which have mouth-fit upper portion, clean and hygienical upper portion, novel and attracting appearance, slippery preventing and easy to grasp body shape.

24 Claims, 5 Drawing Sheets

BEVERAGE CAN

DESCRIPTION OF PRIOR ART

Currently manufactured cans have cylindrical liquid-containing body portions with top portions being recessed within the cylindrical portins, forming upstanding annular rims. Cans proposed by some U.S. patents like U.S. Pat. Nos. 3,825,151, 3,692,202 also have upstanding rims. None of the cans provide comfortable mouth-fit upper portions.

Dust, soil, dirty and unhygienical things are often stuck and deposited on both lateral and top surfaces of cans, while the cans being placed at stores or other places waiting to be sold and while being transported from manufacturing places to selling places. People usually have to touch, with lips, the unhygienical upper lateral surfaces of the cans. Moreover, during drinking process, some liquid contents may stay in annular grooves (which are immediately inside the rims and are at the outer edge of the top surfaces), solving dirty things deposited in the grooves. The dirty solutions are usually drunk in together with clean contents inside the cans.

Currently manufactured cans have cylindrical lateral surfaces. Cans proposed by some U.S. patent, on the whole, also have cylindrical body portion. Although generally speaking cylindrical or round-shape liquid container have bigger volume to hold more liquid, their tens of years lasting round shape look so ordinary to customers that some changefrom cylindrical or nearly cylindrical shape to other shapes will be welcomed and the changemight bring a lot better sale.

Some patents have the object of overcoming the shortcoming that currently manufactured cans are slippery and not easy to grasp. They have detachable or undetachable handles or tabs. It might increase production cost to have the undetachable handles or tabs. And it might increase inconvenience in mounting the detachable handles.

BRIEF SUMMARY OF THE INVENTION

One of the purposes of this invention is to overcome the shortcomings of the prior art described in Description of Prior Art.

This invention is intended to provide for society some kinds of drinking vessels which have some or all of the following advantages: mouth-fit upper portion, clean and hygienical upper portion, novel and attracting appearance, slippery-preventing and easy to grasp body shape.

DETAILED DESCRIPTION

Figure 1:
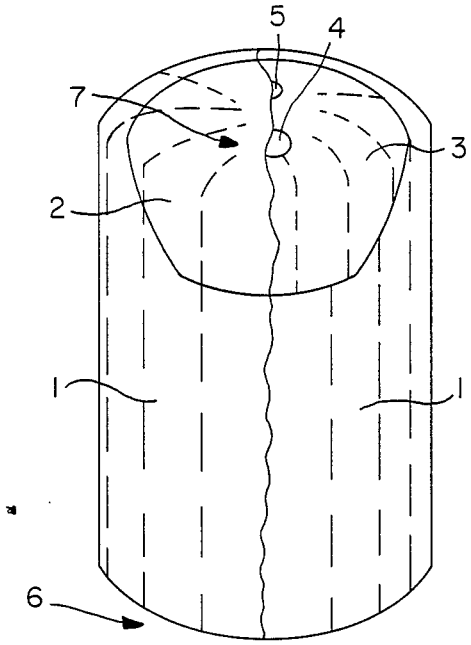
FIG. 1's left part is a perspective view of one embodiment of the invention and FIG. 1's right part is when the upper portion of outer sheet is removed.
Figure 2:
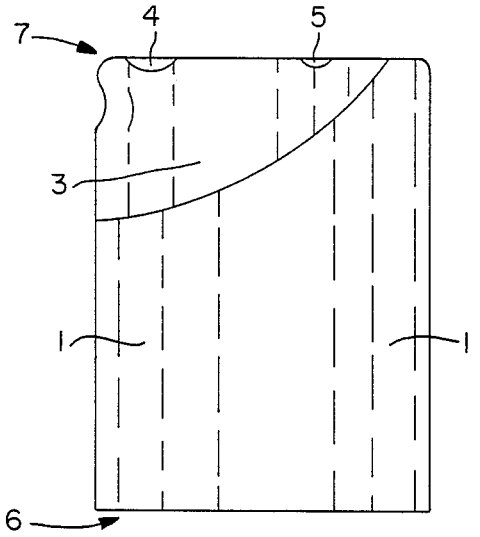
FIG. 2 is the side elevational view corresponding to the same embodiment as FIG. 1, when the upper portion of outer sheet is removed.
Figure 3:
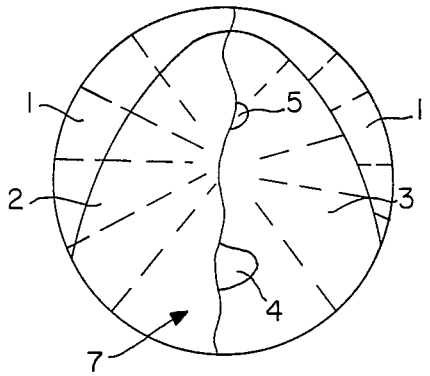
FIG. 3's left part is a top plan view and FIG. 3's right part is when part of the outer sheet is removed.
Figure 4:
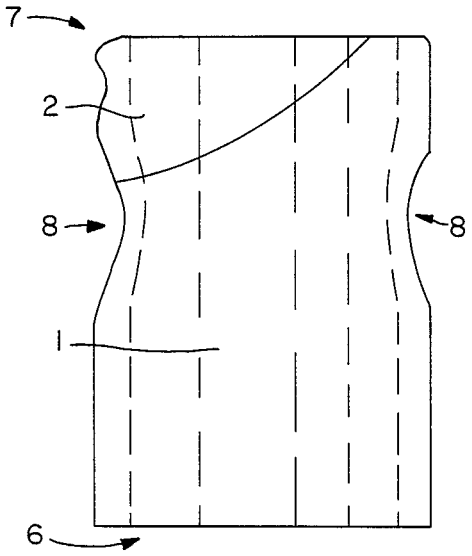
FIG. 4 is a side elevational view of the can with two concave grooves to facilitate grasp and to prevent slippery from hand.
Figure 5:
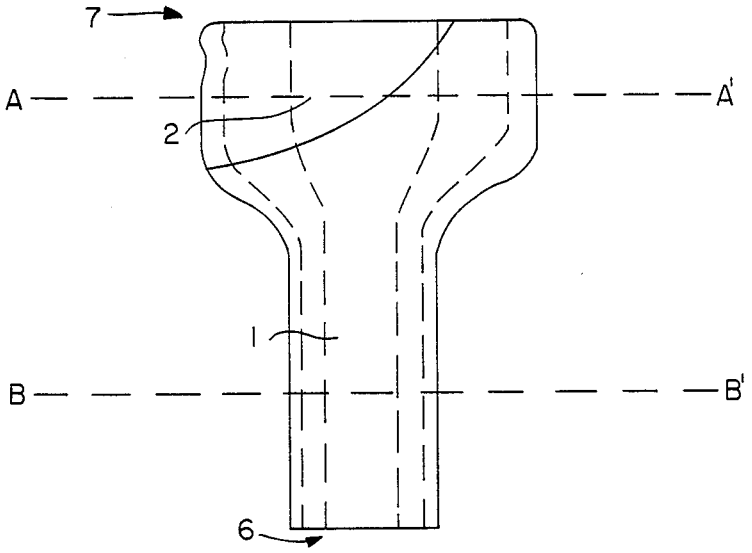
FIG. 5 is a side elevational view of a round-oval combining lateral shape can.
Figure 6:
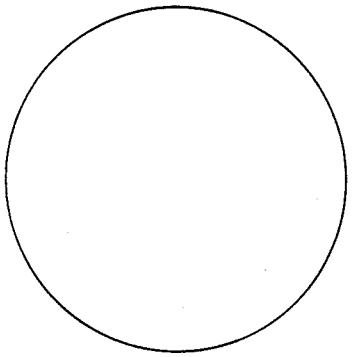
FIG. 6 is a top plan view at A—A' cross section of FIG. 5.
Figure 7:
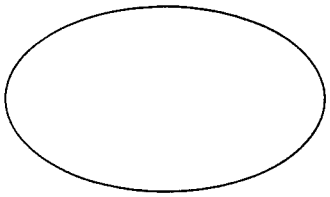
FIG. 7 is a top plan view at B—B' cross section of FIG. 5.
Figure 8:
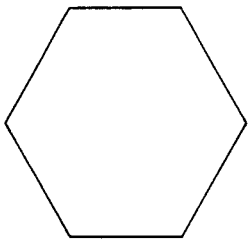
FIG. 8 is the cross section of a hexagonal lateral shape can.
Figure 9:
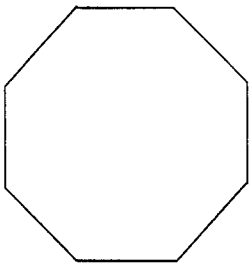
FIG. 9 is the cross section of an octagonal lateral shape can.

The cans according to this invention neither have the upstanding rims which make people's lips uncomfortable, nor have the grooves on can's tops which hold dirty things. The cans according to this invention all have mouth-fit upper portions 7. They may have novel and attracting oval, round-oval combining like FIG. 5 through FIG. 7, hexagonal like FIG. 8, or octagonal like FIG. 9 lateral shape, as well as the ordinary cylindrical lateral shape.

Some of the cans are such that their top and lateral portions are built by two sheets of metal or other materials, like FIG. 1 through FIG. 5. Part of the top portion of the outer sheet and part of the upper lateral portion of the outer sheet, noted as 2, may be removed, revealing a mouth-fit hygienical inner sheet 3 for people's lips to touch. On the inner sheet 3 there may be a drain hole 4 and a hole 5 which is to let air get in, or there may be only one drain hole 4. Some of the cans, like FIG. 4, may have two concave grooves 8 to prevent slippery from hand and to facilitate grasp. Bottom piece 6 is firmly joined to the lower edge of can's lateral portion, forming a rim. Each sheet may have even thickness, or uneven thickness to increase strengh.

Figure 10:
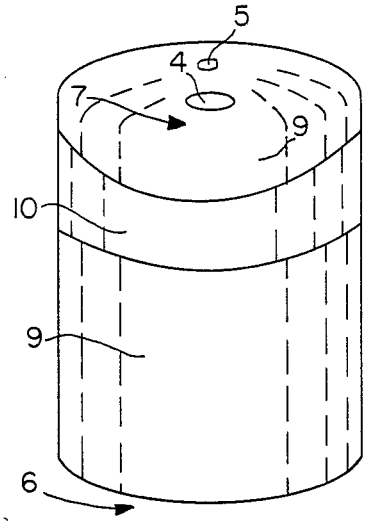
FIG. 10 is a perspective view of another embodiment of the invention, with part of covering sheet removed.

Some of the cans, like FIG. 10, may have a main sheet 9 and a covering sheet 10 which covers the top portion and some of the upper part of the lateral portion of the main sheet 9. The covering sheet 10 may be partly or wholely removed.

Figure 11:
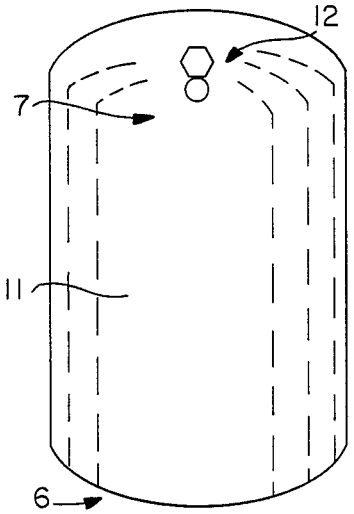
FIG. 11 is a persepctive view of still another embodiment of the invention.

Some of the cans, like FIG. 11, may have on integral sheet 11 as top and lateral portion, with an opening means 12.

I claim:

1. A beverage container comprising: a top portion, a lateral portion, and a bottom portion, said top portion and said lateral portion of said container being integrally formed from a single inner sheet of metallic material, means joining said bottom portion to a lower edge of said lateral portion formed by said inner sheet; a second, outer sheet of metallic material overlying said top portion and at least an adjacent upper part of said lateral portion of said inner sheet; opening means enabling the content of said container to pass through an upper portion of said inner sheet; revealing means for enabling displacement of an upper portion of said outer sheet to reveal said opening means; the upper portion of said inner sheet having a predetermined mouth-fit shape.

2. A container as claimed in claim 1, wherein said lateral portion has approximately oval shape.

3. A container as claimed in claim 1, wherein the upper part of said lateral portion has substantially round cross section and the lower part of said lateral portion has approximately oval cross section.

4. A container as claimed in claim 1, wherein said lateral portion has a hexagonal shape.

5. A container as claimed in claim 1, wherein said lateral portion has an octagonal shape.

6. A beverage container having a top portion, a lateral portion and a bottom portion, and characterized in that the top portion and the lateral portion of said container are formed integrally from a single sheet of metallic material, the top portion of said container having a predetermined mouth-fit shape, and said bottom being made of one sheet of metallic material joined to the lower edge of said lateral portion formed from said first sheet, and opening means formed in said first sheet for enabling the content of said container to pass through said top portion of said container.

7. A container as claimed in claim 6, wherein said lateral portion has approximately oval shape.

8. A container as claimed in claim 6, wherein the upper part of said lateral portion has substantially round cross section and the lower part of said lateral portion has approximately oval cross section.

9. A container as claimed in claim 6, wherein said lateral portion has hexagonal shape.

10. A container as claimed in claim 6, wherein said lateral portion has octagonal shape.

11. A beverage container having a top portion, a lateral portion and a bottom portion, and characterized in that the top portion and the lateral portion of said container are integrally formed from a single main sheet of metallic material, and in that a covering sheet covers a top part of said main sheet and an upper part of a lateral part of said main sheet, the top portion of said container having a predetermined mouth-fit shape, and in that said bottom portion is made of one sheet of material joined to a lower edge of said lateral portion, and in that revealing means enable at least a part said covering sheet to be displaced, and in that opening means enable the content of said container to pass through an upper portion of said main sheet upon displacement of said at least part of said covering sheet.

12. A container as claimed in claim 11, wherein said lateral portion has approximately oval shape.

13. A container as claimed in claim 11, wherein the upper part of said lateral portion has substantially round cross section and the lower part of said lateral portion has approximately oval cross section.

14. A container as claimed in claim 11, wherein said lateral portion has hexagonal shape.

15. A container as claimed in claim 11, wherein said lateral portion has octagonal shape.

16. A container as claimed in claim 11 wherein said lateral portion has concave grooves to facilitate grasping thereof.

17. A container as claimed in claim 11 wherein said lateral portion is substantially cylindrical in cross-section.

18. A container as claimed in claim 11 wherein said lateral portion is polygonal in cross-section.

19. A container as claimed in claim 6 wherein said lateral portion has concave grooves to facilitate grasping thereof.

20. A container as claimed in claim 6 wherein said lateral portion is substantially cylindrical in cross-section.

21. A container as claimed in claim 6 wherein said lateral portion is polygonal in cross-section.

22. A container as claimed in claim 1 wherein said lateral portion has concave grooves to facilitate grasping thereof.

23. A container as claimed in claim 1 wherein said lateral portion is substantially cylindrical in cross-section.

24. A container as claimed in claim 1 wherein said lateral portion is polygonal in cross-section.

* * * * *